US006073363A

United States Patent [19]

Lee

[11] Patent Number: 6,073,363

[45] Date of Patent: Jun. 13, 2000

[54] OPENING/CLOSING DEVICE FOR DISCHARGE HOLE OF FILTER-DRIER

[75] Inventor: Yong Jin Lee, Seoul, Rep. of Korea

[73] Assignee: Jung Hyun Plant Co., Ltd., Kyongki-do, Rep. of Korea

[21] Appl. No.: 09/182,181

[22] Filed: Oct. 30, 1998

[30] Foreign Application Priority Data

Apr. 23, 1998 [KR] Rep. of Korea ..... 98-6498

[51] Int. Cl.[7] ..... F26B 19/00

[52] U.S. Cl. ..... 34/85

[58] Field of Search ..... 34/60, 61, 63, 34/70, 71, 85; 210/679, 193, 232, 492, 503; 96/114, 146, 408; 137/204, 341

[56] References Cited

U.S. PATENT DOCUMENTS

| | | | |
|---|---|---|---|
| 3,550,775 | 12/1970 | Cooley . | |
| 3,753,499 | 8/1973 | Gwilliam . | |
| 3,900,403 | 8/1975 | Randle et al. . | |
| 4,664,812 | 5/1987 | Klein | 210/679 |
| 5,107,604 | 4/1992 | Kataoka | 34/85 X |
| 5,720,550 | 2/1998 | Akiyama et al. | 366/139 |
| 5,867,918 | 2/1999 | Deike et al. | 34/85 X |

FOREIGN PATENT DOCUMENTS

| | | |
|---|---|---|
| 57-56006 | 4/1982 | Japan . |
| 58-17812 | 2/1983 | Japan . |
| 58-139715 | 8/1983 | Japan . |

*Primary Examiner*—Stephen Gravini
*Attorney, Agent, or Firm*—James Creighton Wray; Mera P. Narasimhan

[57] ABSTRACT

An opening/closing device for a discharge hole of a filter-drier is disclosed, in which an outer shell of a driving means for driving the opening/closing device of the discharge hole is sealed, so that during the discharge of the processed powders, the processed powders can be prevented from being introduced into the outer shell. A discharge tube 1 is fastened to the discharge hole 4 by means of a fastening device 1*a*, so that processed drug powders can be discharged though a discharge tube hole 4*a*. A cylindrical opening 2*c* is formed inside a flange 2*b* of the outer shell 2. A sealing cover 3*b* extends from the opening/closing plate 3 to be inserted into the opening 2*c*, and the sealing cover 3*b* is longer than the actuation distance of the opening/closing plate 3. The sealing cover 3*b* does not depart from the opening 2*c*, but is always maintained within the opening 2*c* to seal off the interior of the outer shell 2. Consequently, when the processed drug powders are discharged through the discharge tube 1 and through the discharge tube hole 4*a*, the drug powders are not introduced into the interior of the outer shell 2.

4 Claims, 3 Drawing Sheets

OPENING/CLOSING DEVICE FOR DISCHARGE HOLE OF FILTER-DRIER

BACKGROUND OF THE INVENTION

1. Field of the Invention

The present invention relates to a filter-drier which carries out mixing, reacting, filtering, washing and drying industrial chemicals or drugs such as antibiotics within a single processing vessel. Particularly, the present invention relates to an opening/closing device for a discharge hole of the filter-drier, in which an outer shell of a driving means for driving the opening/closing device of the discharge hole is sealed, so that during the discharge of the processed powders, the processed powders can be prevented from being introduced into the outer shell.

2. Description of the Prior Art

Conventionally, there are known many kinds of opening/closing devices for the discharge hole of the filter-drier. However, the outer shell of the driving means which opens or closes the discharge hole is not sealed. Therefore, when the processed drug powders are discharged out of the filter-drier, the fine drug powders are scattered to around the driving means of the opening/closing plate to adhere on the plate. Thus much of the valuable drug powders are lost, and the cleaning of the plate is troublesome.

One of the conventional opening/closing devices will be taken as an example.

Japanese Patent Gazette No. Sho-60-7930 (dated Feb. 28, 1985) discloses a discharge device of a filter-drier constituted as follows. A discharge hole is formed at the center of the bottom of a processing vessel, and a warhead shaped discharge tube moves up and down above the discharge hole. Around the discharge tube, there are formed a plurality of outlet holes. Thus if the discharge tube moves up into the processing vessel, the processed drug powders are discharged through the outlet holes, while if the discharge tube moves down, the discharge hole is closed by the head of the discharge tube.

This discharge device constituted as described above works smooth in the case of liquid materials. However, in the case of powdered materials, the processed powders adhere on around the discharge tube. It is a troublesome task to remove the adhered powders, and therefore, the adhered materials remain always within the filtering vessel.

Meanwhile, Japanese Patent Gazette No. Sho-58-35726 (dated Aug. 4, 1983) discloses a discharge device of the filtering vessel constituted as follows. A discharge hole is formed at the center of the bottom of the processing vessel, and a discharge tube is disposed beneath the discharge hole. Further, a warhead shaped opening/closing plate is formed at the center of the discharge tube, and the warhead shaped opening/closing plate moves up and down to open or close the discharge hole.

In this device, if the opening/closing plate moves down, the discharge hole is opened. However, the drug powders are accumulated on the opening/closing plate, and therefore, the cleaning is difficult, while the expensive drug powders are lost very much.

Meanwhile, another conventional discharge device of the filter-drier is illustrated in FIG. 3. In this discharge device, a tapered outer shell 2 of an opening/closing plate driving means A is detachably fastened onto a discharge tube 1 by means of a fastening device 2*a*. A motor 5 which actuates an opening/closing plate 3 is fixed on an end portion of the outer shell 2 of the driving means A. A screw shaft 6 which is threadably coupled with a nut 6*b* of a movable tube 6*a* is made to revolve at a slow speed by the motor 5 and a reduction device 5*a*. A sliding protuberance 7*a* of the movable tube 6*a* is guided along a guide groove 7*a* of a guide tube 7 without being rotated. The movable tube 6*a* moves back and forth in accordance with the revolutions of the screw shaft 6. The opening/closing plate 3 is fastened by means of a fastening device 3*a* to the leading end of the movable tube 6*a*, so that a discharge device 4 can be opened or closed in accordance with the back-and-forth movements of the movable tube 6*a*. A bellows 8 is formed around the guide tube 7, so that the lubricant would not be leaked from the screw shaft 6.

The conventional discharge device of FIG. 3 is useful both for liquid and powdered materials. Further, the movements of the agitating blades which are installed within the filter-drier are not interfered by the discharge device. However, the discharge hole 4 faces toward the outer shell 2 of the driving means of the opening/closing plate 3, and the inner portion of the outer shell 2 is open. Therefore, when the processed drug powders are discharged through the discharge hole, a part of the processed drug powders is introduced into the interior of the outer shell 2. Because of this leakage, the outer shell 2 has to be detached from the discharge tube 1 after each discharge of the drug powders so as to be cleaned, this being a troublesome task. When the cleaning is carried out, the expensive drug powders are lost very much, and therefore, it is difficult to efficiently process the drugs.

SUMMARY OF THE INVENTION

The present invention is intended to overcome the above described disadvantages of the conventional techniques.

Therefore it is an object of the present invention to provide a discharge device for a filter-drier, in which when an opening/closing plate opens a discharge hole of the filter-drier, it spatially closes the outer shell of the opening/closing device, so that the processed drug powders can be prevented from being introduced into the interior of the outer shell during their discharge, thereby making it possible to carry out the processing in a simple efficient manner.

In achieving the above object, the opening/closing device for a discharge hole of the filter-drier according to the present invention includes: an outer shell of a driving means for an opening/closing plate, the outer shell being attached to a discharge tube, and the discharge tube being formed on a side of a bottom of the filter-drier; and the opening/closing plate being for opening and closing the discharge hole in accordance with back-and-forth movements of the opening/closing plate by the help of the driving means.

The opening/closing device further includes: the outer shell having a cylindrical shape; an opening formed at an end of the outer shell; and a cylindrical sealing cover extending from the opening/closing plate so as to be inserted into the opening, whereby the outer shell is made to have a sealed interior.

Therefore, when processed drug powders or the like are discharged out of the filter-drier through the discharge hole and the discharge tube, the drug powders are prevented from being introduced into the interior of the outer shell. Therefore, the outer shell needs not be cleaned each time of the discharge, and the loss of the expensive drug powders does not occur. Since the cleaning is eliminated, drugs can be processed in convenient and efficient manner.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENT

Figure 1:
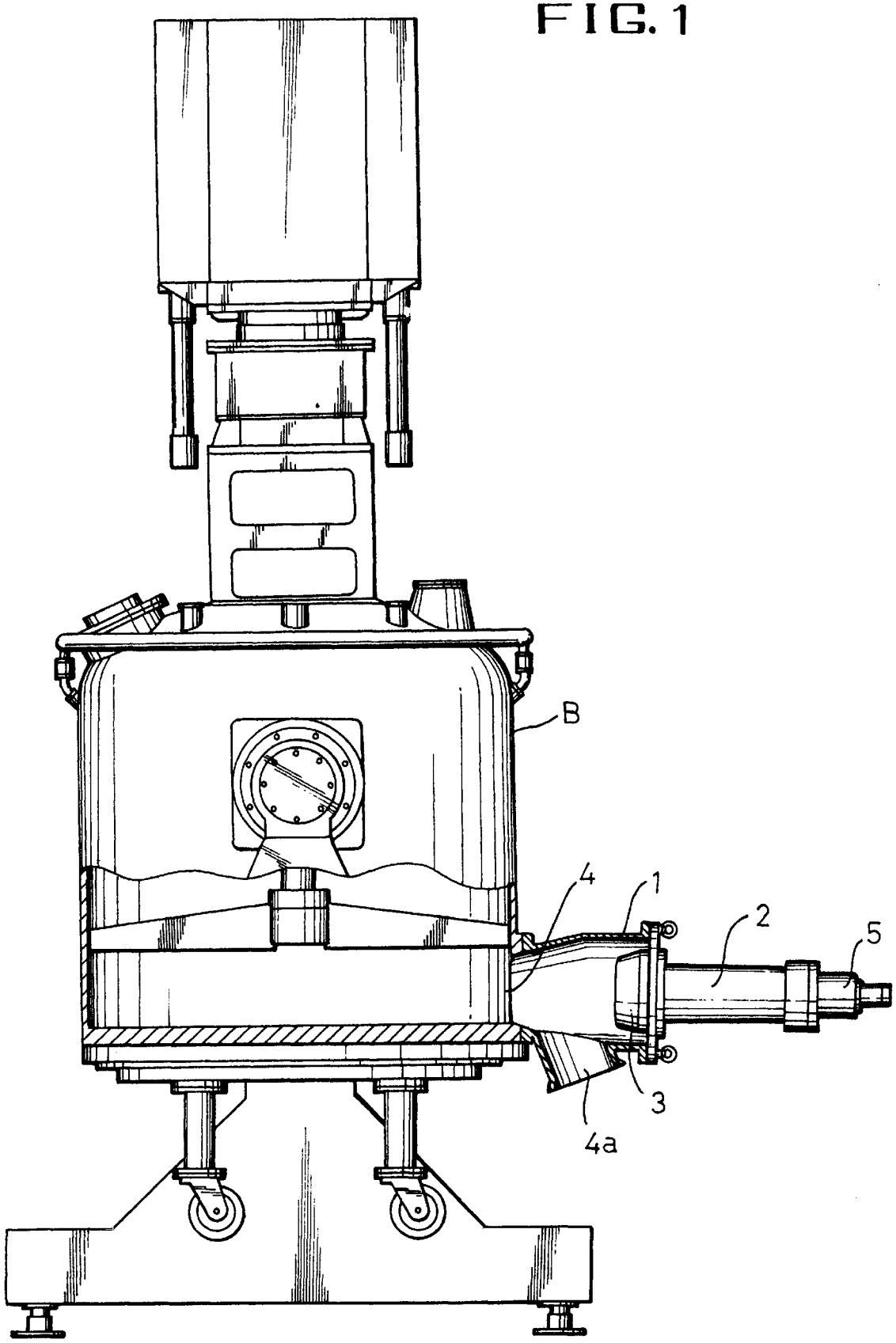
FIG. 1 is a partly cut-out side view of the discharge device according to the present invention.
Figure 2:
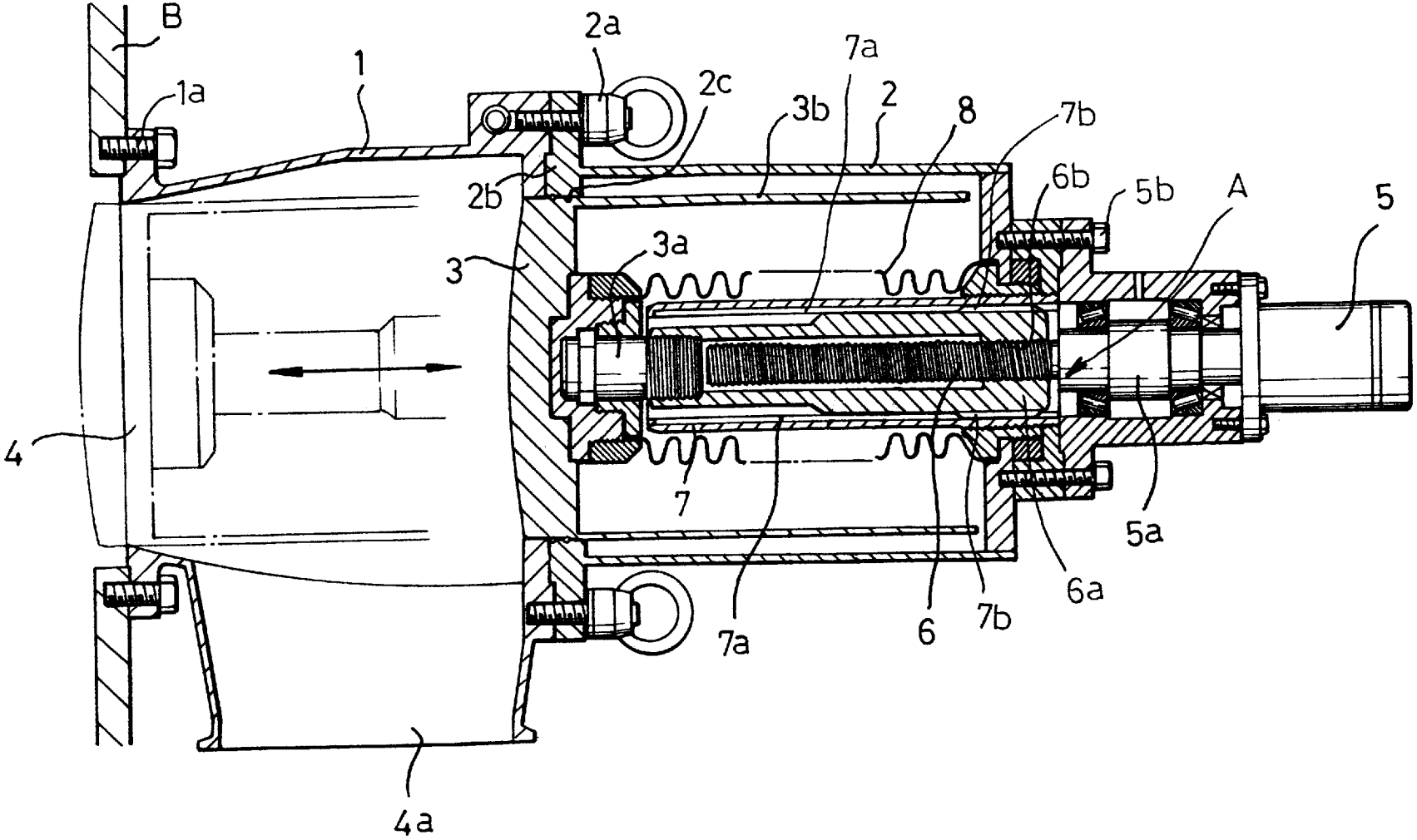
FIG. 2 is a partly cut-out side view of the discharge device of the present Invention, in which the sealing cover of the opening/closing plate is inserted into the opening to seal the interior of the outer shell even when the discharge hole is opened.
Figure 3:
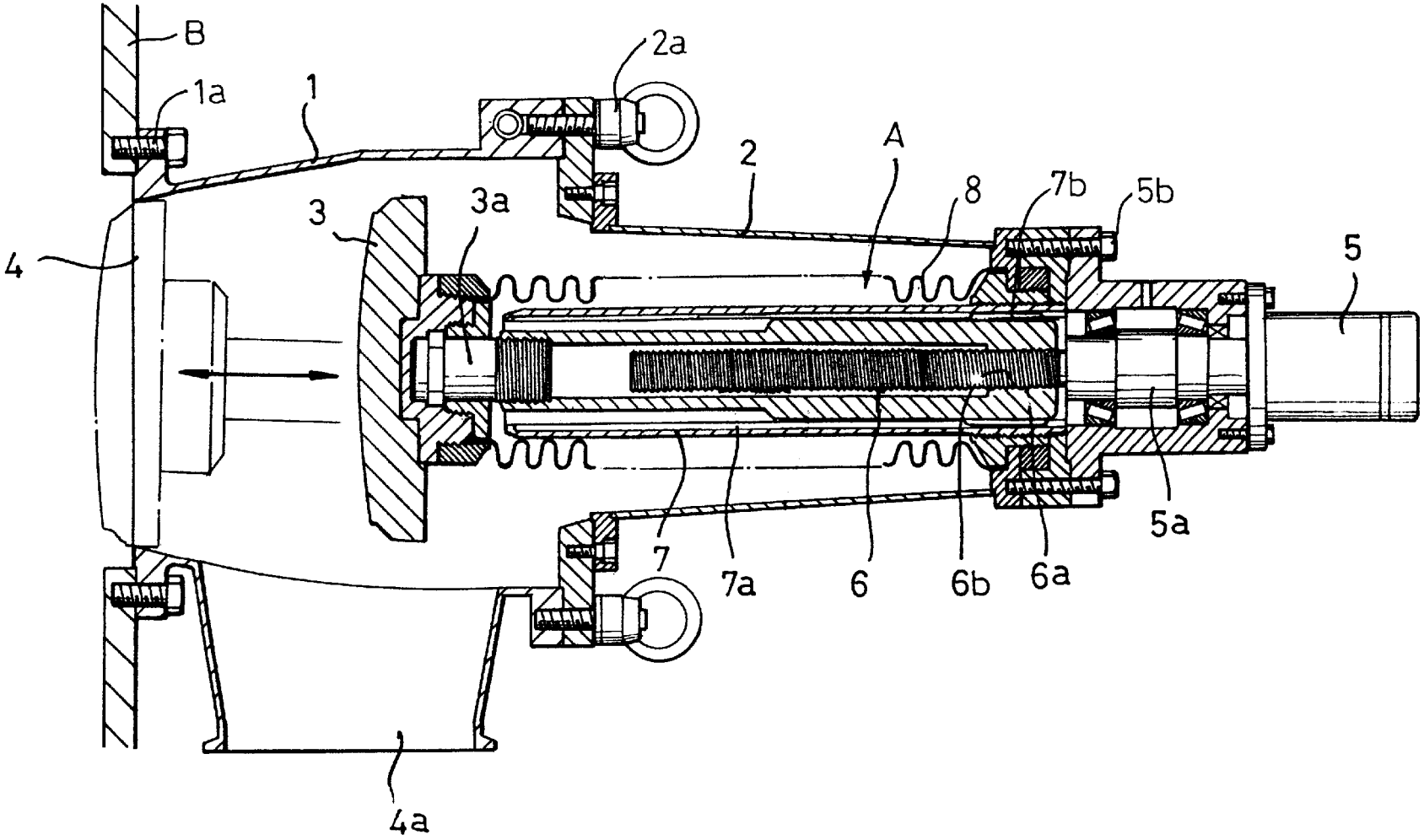
FIG. 3 illustrates a conventional opening/closing device for the discharge hole of the filter-drier, in which the outer shell is open in accordance with the opening of the discharge tube.

The present invention is illustrated in FIG. 2. The processing vessel B of a general filter-drier has a discharge hole 4. A discharge tube 1 is fastened to the discharge hole 4 by means of a fastening device 1*a*, so that processed drug powders can be discharged through a discharge tube hole 4*a*. A cylindrical outer shell 2 of a driving means A for driving an opening/closing plate 3 is detachably fastened to an end of a discharge tube 1 by means of a fastening device 2*a*. A motor 5 which drives the opening/closing plate is fastened to the outer end of the outer shell 2 by means of fastening screws 5*b* together with a reduction device 5*a*. A screw shaft 6 of the reduction device 5*a* which is connected to the motor 5 is threadably coupled with a nut 6*b* which is formed on a movable tube 6*a*. A sliding protuberance 7*b* of the movable tube 6*a* is guided along a guide groove 7*a* of a guide tube 7. Thus the movable tube 6*a* moves back and forth in accordance with the forward or reverse revolutions of the screw shaft 6. The opening/closing plate 3 is fastened through a joining device 3*a* to the leading end of the movable tube 6*a*, and a bellows 8 covers around the guide tube 7. The above described structures are same as those of the conventional device of FIG. 3.

The unique features of the present invention are as follows. That is, a cylindrical opening 2*c* is formed inside a flange 2*b* of the outer shell 2 (which is fastened to one end of the discharge tube 1). The diameter of the opening is as large as the outside diameter of the opening/closing plate 3. A sealing cover 3*b* extends from the opening/closing plate 3 to be inserted into the opening 2*c*, and the sealing cover 3*b* is longer than the actuation distance of the opening/closing plate 3. Thus, the opening/closing plate 3 moves back and forth in accordance with the driving of the motor 5 of the driving means A. During this movements, the sealing cover 3*b* does not depart from the opening 2*c*, but is always maintained within the opening 2*c* to seal off the interior of the outer shell 2. Thus the interior of the outer shell 2 is always sealed by being blocked from the discharge tube 1. Consequently, when the processed drug powders are discharged through the discharge tube 1 and through the discharge tube hole 4*a*, the drug powders are not introduced into the interior of the outer shell 2.

Now the operation of the device of the present invention will be described.

During the time when a drug is reacted, filtered, washed and dried, the opening/closing plate 3 firmly closes the discharge hole. 4 of the processing vessel B. The closing actuation of the opening/closing plate 3 is done in the following manner. That is, as shown in FIG. 2, if the motor 5 is driven, the screw shaft 6 is slowly revolved by the reduction device 5*a*. Then the screw shaft 6 revolves relative to the screw nut 6*b* of the movable tube 6*a*, and thus, the movable tube 6*a* slowly advances with the sliding protuberance 7*b* inserted into the guide groove 7*a*. Therefore, the opening/closing plate 3 closes the discharge hole 4 as shown by the dotted lines. When the opening/closing plate 3 closes the discharge hole 4, a sensor (not illustrated) makes to the motor 5 stopped.

When the drug is completely processed, the processed drug is discharged by opening the discharge hole 4 of the filter-drier. The opening of the discharge hole 4 is carried out in the following manner. That is, the screw shaft 6 is rotated in the reverse direction by driving the motor 5 and the reduction device 5*a*. If the screw shaft 6 rotates in the reverse direction relative to the screw nut 6*b* of the movable tube 6*a*, then the movable tube 6*a* withdraws, with the result that the opening/closing plate 3 also withdraws to open the discharge hole 4. At the same time, the sealing cover 3*b* of the opening/closing plate 3 enters deeper into the opening 2*c*, and therefore, the interior of the outer shell 2 is maintained in the sealed state. Accordingly, when the drug is completely processed, and when the processed drug powders are discharged through the discharge hole 4 by the action of the agitating blades, the processed drug powders cannot enter into the interior of the outer shell 2.

When the interior of the discharge tube 1 needs be cleaned, the fastening device 2*a* is detached, and the outer shell 2 is disassembled to clean the discharge tube 1 like the conventional manner. However, since the interior of the outer shell 2 is maintained in the sealed state, the outer shell 2 does not have to be cleaned. The inside of the discharge tube 1 can be easily cleaned.

According to the discharge device of the filter-drier of the present invention, since the interior of the outer shell is sealed by the sealing cover (which has entered into the opening), when the opening/closing plate is made to move back and forth by activating the driving means, the interior of the outer shell is maintained in the sealed state. Therefore, when the processed drug powders are discharged, the fine drug powders are prevented from entering into the interior of the outer shell, thereby realizing the object of the present invention. Further, owing to the bellows and the sealing cover, the lubricant of the driving means cannot leak to the outside, with the result that the drug powders are not contaminated, thereby improving the safety. Further, the structural constitution of the device is simple, and therefore, the discharge tube can be easily cleaned. Further, its use is easy, and therefore, the drug processing can be carried out in an efficient manner.

What is claimed is:

1. An opening/closing device for a discharge hole of a filter-drier, comprising: an outer shell of a driving means of an opening/closing plate, said outer shell being attached to a discharge tube, and said discharge tube being formed on a side of a bottom of said filter-drier; said driving means being accommodated within said outer shell; a screw shaft connected to a motor through a reduction device, and threadably coupled to a screw nut of a movable tube; and said opening/closing plate being for opening and closing said discharge hole in accordance with its back-and-forth movements by a help of said driving means, said opening/closing device further comprising:

said outer shell having a cylindrical shape;

an opening formed at an end of said outer shell and inside a flange; and a cylindrical sealing cover extending from said opening/closing plate so as to be inserted into said opening, whereby said outer shell is made to have a sealed interior, and when processed drug powders are discharged out of said filter-drier through said discharge hole and said discharge tube, the drug powders are prevented from being introduced into the interior of said outer shell.

2. The opening/closing device as claimed in claim 1, wherein said opening/closing plate advances or withdraws to close or open said discharge hole of said filter-drier, and said sealing cover enters or withdraws through said opening of said outer shell, in a state with the interior of said outer shell sealed.

3. The opening/closing device as claimed in claim 1, wherein said sealing cover has an outside diameter as large as to completely fill said opening of said outer shell; and said sealing cover has a length as large as not to depart from said opening.

4. The opening/closing device as claimed in claim 1, wherein said driving means for said opening/closing plate is dually covered with said sealing cover and a bellows.

* * * * *